United States Patent [19]

Allard

[11] 4,239,794

[45] Dec. 16, 1980

[54] PROCESS OF DISPERSING ELECTRO-CONDUCTIVE CARBON BLACK AND WEB PRODUCT MADE THEREBY

[75] Inventor: Adrien W. Allard, Colora, Md.

[73] Assignee: Ludlow Corporation, Needham Heights, Mass.

[21] Appl. No.: 931,142

[22] Filed: Aug. 4, 1978

Related U.S. Application Data

[63] Continuation-in-part of Ser. No. 733,137, Oct. 18, 1976.

[51] Int. Cl.[3] ..... B32B 5/30; B32B 27/02; B32B 27/14; B32B 33/00

[52] U.S. Cl. ..... 428/219; 428/220; 428/244; 428/265; 428/283; 428/290

[58] Field of Search ..... 252/8.7; 106/308 Q; 428/283, 289, 337, 338, 339, 483, 538, 408, 224, 368, 372, 378, 219, 220, 290, 244, 265

[56] References Cited

U.S. PATENT DOCUMENTS

| | | | |
|---|---|---|---|
| 3,498,875 | 3/1970 | Lindemann et al. | 428/338 X |
| 3,582,448 | 6/1971 | Okubashi et al. | 428/244 X |
| 3,586,596 | 6/1971 | Ainsworth et al. | 428/244 |
| 3,865,626 | 2/1975 | Diener et al. | 428/408 |
| 3,969,559 | 7/1976 | Boe | 428/397 X |
| 4,061,811 | 12/1977 | Takase et al. | 428/368 X |
| 4,061,827 | 12/1977 | Gould | 428/368 |

*Primary Examiner*—James C. Cannon

*Attorney, Agent, or Firm*—Robert A. Cesari; John F. McKenna; Andrew F. Kehoe

[57] ABSTRACT

Novel process for dispersing electroconductive carbon black to make novel conductive web products and the dispersions produced therewith. The process comprises dispersing said carbon black in an aqueous media using tris (2,3 dibromopropyl) phosphate, or the like, as a dispersing agent and then coating a porous fibrous substrate with the resulting carbon black dispersion.

4 Claims, 2 Drawing Figures

Figure 1:
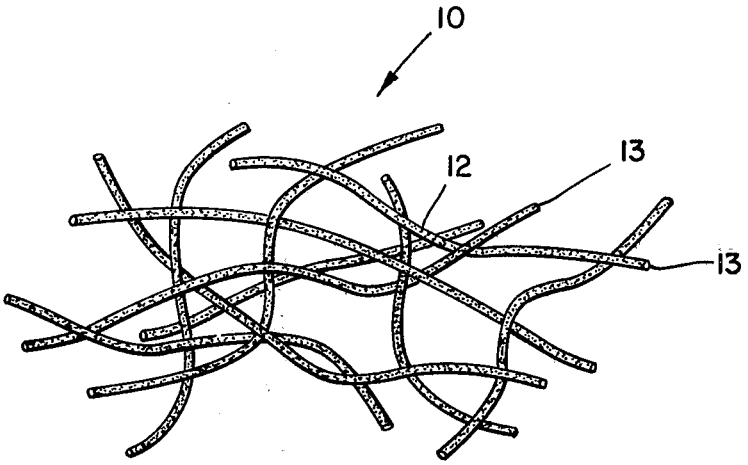

PROCESS OF DISPERSING ELECTRO-CONDUCTIVE CARBON BLACK AND WEB PRODUCT MADE THEREBY

RELATED APPLICATION

This application is a continuation in part of U.S. Application Ser. No. 733,137 filed on Oct. 18, 1976.

BACKGROUND OF THE INVENTION

Dispersing of electroconductive particles in webs such as paper, non-woven fabrics, felts and the like has long been practiced to enhance the electroconductivity thereof. Carbon black has been used in such work, albeit the relatively low conductivity has limited severely the applications in which it may be used. Moreover, carbon black is difficult to disperse on the surface of a fiber so a given quantity of the black has, in most systems, not yielded the highest degree of conductivity which was theoretically obtainable in view of the properties of the black pigment.

A substantial amount of work has been done in improving the dispersability of carbon black in aqueous solutions. For example, corrosive type materials like ammonium hydroxide, have been suggested (U.S. Pat. No. 3,152,996 and 3,118,884). Moreover, polyethoxylated amines have been suggested (U.S. Pat. No. 3,565,658).

Some inventors have attempted to increase the conductivity of carbon black or metal pigment-bearing coatings in synthetic polymer films, e.g. on polyester film, by etching the surface of the film with adjuvants contained within the coating composition and thereby achieve better coverage of the film on the coated substrate. Thus, U.S. Pat. No. 3,865,626 reveals the use of such a procedure wherein the etchants are halogenated hydrocarbons phenols, or halogenated lower fatty acids.

In a hindsight evaluation of the invention to be disclosed below, it is also noted that tri-alkyl phosphate and other phosphate-type compounds are known as wetting agents (U.S. Pat. Nos. 2,794,004; 3,138,629; and 3,799,956) in certain applications.

SUMMARY OF THE INVENTION

This invention relates to making a porous fibrous substrate which has improved surface conductivity achievable by carbon black dispersed on the surface of the substrate fibers.

The problem faced by the inventor is to get enough carbon black into a coating material to achieve the required population of carbon black particles on the surface of the fibers; to simultaneously get sufficient dispersion of the carbon black particles that you do have to avoid excessive agglomeration of the particles and, consequent loss of ability to impart electroconductivity; and to achieve the dispersion of the required population of carbon black without an excessive build-up in the viscosity of the coating mixture. In many applications, build-up of the coating viscosity would not be a major problem. However, in the problem faced by Applicant there is a necessity to get the coating to flow through and contact the interstices between fibers of a permeable web with efficiency. It is the fibers which are being coated—not merely a planar surface of a film.

Therefore, the objects of the present invention are to provide (1) an improved process for dispersing conductive carbon black, (2) improved aqueous dispersions of carbon conductive black, especially furnace blacks, and (3) improved fibrous based web products which comprise electroconductive, carbon black coatings thereon.

Other objects of the invention will be obvious to those skilled in the art on reading this disclosure.

The above objects have been achieved by utilizing, as a coating medium, an aqueous dispersion of carbon black which is characterized by a relatively low viscosity despite the excellent dispersion of minute carbon black therein. The carbon black is also aided in its retention on the exterior surfaces of the fiber by a polymeric binder. The binder, however, is in latex form and, apparently, this helps keep the carbon surface from being insulated by the polymer film.

Thus, for the first time, it is possible to achieve coated, permeable fibrous webs having electroresistivities well below 200,000 ohms per square, merely as a consequence of carbon black distributed on the surface thereof.

Ideally, the web is a non-woven mat, e.g. a spunbonded mat, of the type well known in the art. The carbon black is a conductive furnace black and said agent is selected from chlorinated organic dispersing agent or organic phosphate dispersing agent. In the most advantageous embodiments of the invention, a latex is used as the source of the binder. This allows the viscosity to be maintained low in the impregnating, i.e. coating, solution and also minimizes coating of the surfaces of the black particles.

The electroconductive carbon black is advantageously one of those known to the art as conductive and generally utilized for conductive and anti-static applications. Those sold under the trade designations Vulcan by Cabot Corporation are typical. Furnace blacks are preferred, although acetylene blacks may be preferred for some applications.

The improved dispersing action obtainable by use of the invention may be dramatized by unusually high viscosities obtainable in relation to the amount of dispersing agent utilized in an aqueous dispersion of a given quantity of carbon black in otherwise similar formulae.

| Parts by Weight Based on Formulation | | | |
|---|---|---|---|
| Dispersing Agent | Carbon | Viscosity cps | Ultimate Med. Resistance ohms |
| 0 | 4.2 | 40 | 2,815,000 |
| 1.0 | 4.2 | 60 | 285,600 |
| 2.0 | 4.2 | 100 | 110,700 |

Often it is desirable to avoid the higher viscosities in most high-speed impregnation processes. A viscosity of between 50 and 70 cps usually indicates a suitable level of carbon dispersion in the formula illustrated hereinbelow.

ILLUSTRATIVE EXAMPLES OF THE INVENTION

In this application and accompanying drawings there is shown and described a preferred embodiment of the invention and suggested various alternatives and modifications thereof, but it is to be understood that these are not intended to be exhaustive and that other changes and modifications can be made within the scope of the invention. These suggestions herein are selected and included for purposes of illustration in order that others skilled in the art will more fully understand the invention and the principles thereof and will be able to modify it and embody it in a variety of forms, each as may be best suited in the condition of a particular case.

IN THE DRAWINGS

FIG. 1 is a schematic diagram showing a magnified segment of the product 10 of the invention with carbon black 12 on the surface of spun-bonded fibers 13.

Figure 2:
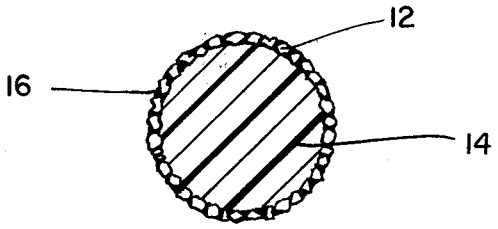

FIG. 2 is a schematic section of a single fiber 11 of the product of FIG. 1 showing carbon particles 12 in particle-to-particle contact along the surface of the synthetic fiber 14 with the carbon particles associated with a latex-derived binder 16.

Electrical conductivities (or resistivity) described herein are measured on 10 inch squares of material which are conditioned at 70° F. and 20% relative humidity for 24 hours prior to testing. Testing is carried out on a BK Precision 280 Digital Multimeter of the type well known in the art. The specimen is placed on a clean, non-conductive surface and the conductivity is measured by attaching alligator clips to diagonally-opposite corners.

The dispersing agents of the invention include chlorinated organic dispersing agents or organic phosphate to dispersing agents. To achieve the desired coating it is desirable to have the viscosity of the dispersion in the organic polymer binder containing material at 100 cps or less. A maximum electroresistivity of about 200,000 ohms per square is advantageous.

EXAMPLE 1

The following describes the invention utilized in making a conductive tufting substrate (used in making tufted carpets), which incorporates an electroconductive carbon in a sufficient quantity to provide the desired conductivity. The carbon should be incorporated in such a way as to avoid being washed or leached from the latex which is used as a binder. The substrate is advantageously formed of an ethylene vinyl acetate copolymer within which a conductive carbon black is dispersed to yield a resistivity of 300,000 ohms per square or less, but most advantageously 200,000 ohms or less.

A tufting substrate suitable for use can be prepared by preparing a non-woven fabric of a blend of regular and high tenacity polyester staple fibers. Typical fibers are those sold under the trade designation E-1, 4212, Type 61G and Type 5576 by DuPont, Barnet Wellman and Leigh companies. These fibers are opened, formed into a dry web using apparatus known to the art (e.g. a webber of the type sold by Rando Corp.) and then needled according to the art. Thereupon, the web is saturated with a binder using a pad-type saturator, oven dried and calendered to appropriate thickness, e.g. about 0.032 inches and about 4.4 ounces per square yard, all as known in the art.

A binder system having a suitable conductivity and coating viscosity is formed of a mixture of the following ingredients:

| Formula A | Parts by Weight (wet) |
|---|---|
| Water | 11.04 |
| Defoamer (silicon type) | 0.049 |
| Polymeric binder (ethylene vinyl acetate latex)* | 37.4 |
| Carbon Black Dispersion (8% solids)** | 50.0 |
| Surfactant*** | 0.497 |
| Tris (2,3 dibromopropyl) phosphate | 1.000 |

*A latex product (55%) solids, sold under the trade designation Elvace 1875 by DuPont.
**Water with fluffy electroconductive-grade carbon black
***Sold under the trade designation Aerosol OT by American Cyanamid This tufting substrate material is conveniently of a weight of about 4 to 5 ounces per square yard, and a thickness of about 0.025 to 0.040 inches. It should have a tensile strength of at least 45 lbs in the cross machines direction, and a trapezoid tear strength of (ASTM D1117) of at least 22 lbs. The percent of fiber is preferably at least 66% of the entire weight of the substrate. The resistivity is about 200,000 ohms per square.

EXAMPLE 2

Example 1 is repeated using 1,1,1-trichloroethane, a chlorinated organic dispersing agent instead of the phosphate compound of Formula A. Although the appearance of the mixture is as good as that of Example 1 and although the viscosity is somewhat higher, e.g. about 270 cps (on a Brookfield viscometer RVF, 20 RPM Spindle No. 2) the impregnated and dried material had an electrical resistance of 192,000 ohms.

EXAMPLE 3

Example 2 is repeated using chloroform as the dispersing agent. Again, the viscosity is rather high (about 290 cps) but the degree of dispersion is reasonably good, yielding a finished product of a resistivity of 163,000 ohms.

EXAMPLE 4

Example 3 is repeated using a phosphate ester dispering agent sold under the trademark NIREX P-35-B by Leatex Chemical Co. A low viscosity of the impregnant and excellent resistivity characteristics (about 150,000 ohms) are achieved.

It is also to be understood that the following claims are intended to cover all of the generic and specific features of the invention herein described and all statements of the scope of the invention which might be said to fall therebetween.

What is claimed is:

1. An electroconductive sheet formed of a permeable non-woven fibrous web comprising a maximum surface electroresistivity of about 200,000 ohms per square and carrying electroconductive an carbon black coating on the surfaces of the fibers from which said sheet is formed, said sheet being formed by a process comprising the steps of (1) dispersing said conductive carbon black in a latex binder using an effective quantity of a dispersing agent selected from a chlorinated organic dispersing agents and an organic phosphate dispersing agents, (2) impregnating the resulting dispersion of carbon black into said web and coating the surface of said fibers with said dispersion, and (3) drying residual water from the surface of the fibers, leaving a thin coating of carbon block dispersed on the surfaces of said fibers.

2. A web as defined in claim 1 wherein said impregnation is carried out while said dispersion has a maximum viscosity of about 100.

3. A web as defined in claim 1 wherein said impregnation is carried out using effective quantities of chlorinated dispersing agents and with dispersions of up to about 200,000 ohms.

4. A web as defined in any of claims 1, 2 or 3 wherein the electroconductive web weighs about 4 to 5 ounces per square yard, has a thickness of about 0.025 to 0.040 inches.

* * * * *